US009010235B2

(12) United States Patent
Drevet

(10) Patent No.: US 9,010,235 B2
(45) Date of Patent: Apr. 21, 2015

(54) ROTARY MACHINE WITH PISTONS AND A BARREL

(75) Inventor: Michel Drevet, Sevres (FR)

(73) Assignee: Michel Drevet (FR)

( * ) Notice: Subject to any disclaimer, the term of this patent is extended or adjusted under 35 U.S.C. 154(b) by 985 days.

(21) Appl. No.: 13/062,639

(22) PCT Filed: Aug. 21, 2009

(86) PCT No.: PCT/IB2009/053685

§ 371 (c)(1),
(2), (4) Date: May 26, 2011

(87) PCT Pub. No.: WO2010/026505

PCT Pub. Date: Mar. 11, 2010

(65) Prior Publication Data

US 2011/0232476 A1 Sep. 29, 2011

(30) Foreign Application Priority Data

Sep. 8, 2008 (FR) ..... 08 04916

(51) Int. Cl.
*F04B 1/14* (2006.01)
*F01B 3/02* (2006.01)
*F01B 3/00* (2006.01)

(52) U.S. Cl.
CPC ..... *F01B 3/02* (2013.01); *F01B 3/0023* (2013.01); *F04B 1/146* (2013.01)

(58) Field of Classification Search
CPC ..... F01B 3/02; F01B 3/0023; F04B 1/146; F04B 1/148
USPC ..... 92/71
See application file for complete search history.

(56) References Cited

U.S. PATENT DOCUMENTS

| | | | | |
|---|---|---|---|---|
| 2,406,291 | A * | 8/1946 | Hall | 92/71 |
| 2,821,932 | A | 2/1958 | Rene | |
| 3,885,444 | A * | 5/1975 | Chanlon | 74/60 |
| 4,495,855 | A * | 1/1985 | Murakami et al. | 92/71 |
| 4,815,327 | A | 3/1989 | Drevet | |

FOREIGN PATENT DOCUMENTS

| | | |
|---|---|---|
| FR | 440808 A | 7/1912 |
| FR | 2588617 A1 | 4/1987 |

* cited by examiner

*Primary Examiner* — F. Daniel Lopez
(74) *Attorney, Agent, or Firm* — The Belles Group, P.C.

(57) ABSTRACT

The invention relates to a rotary machine with pistons (22) and a turret (25), including: —a frame (2), through which a shaft (1) extends, having a geometrical axis x-x' and mounted in a stationary manner relative to the frame (2); —a thrust plate (9) rotatably mounted on the shaft (1); —an oscillating plate (15) bearing on the thrust plate (9); —a torsion bar (18), a first end of which is pivotably connected to the frame (2) and a second end of which is pivotably connected to the oscillating plate (15); —a spherical female bushing (14) rigidly connected to the oscillating plate (15) and pivotably connected around a spherical male knuckle centered on the shaft (1), the knuckle including a spherical male bushing (10) rotatably mounted relative to the shaft (1), characterized in that the rotary machine includes a means for rotating the spherical male bushing (10) about the geometric axis x-x'.

8 Claims, 2 Drawing Sheets

ROTARY MACHINE WITH PISTONS AND A BARREL

CROSS REFERENCE TO RELATED APPLICATIONS

Figure 1:
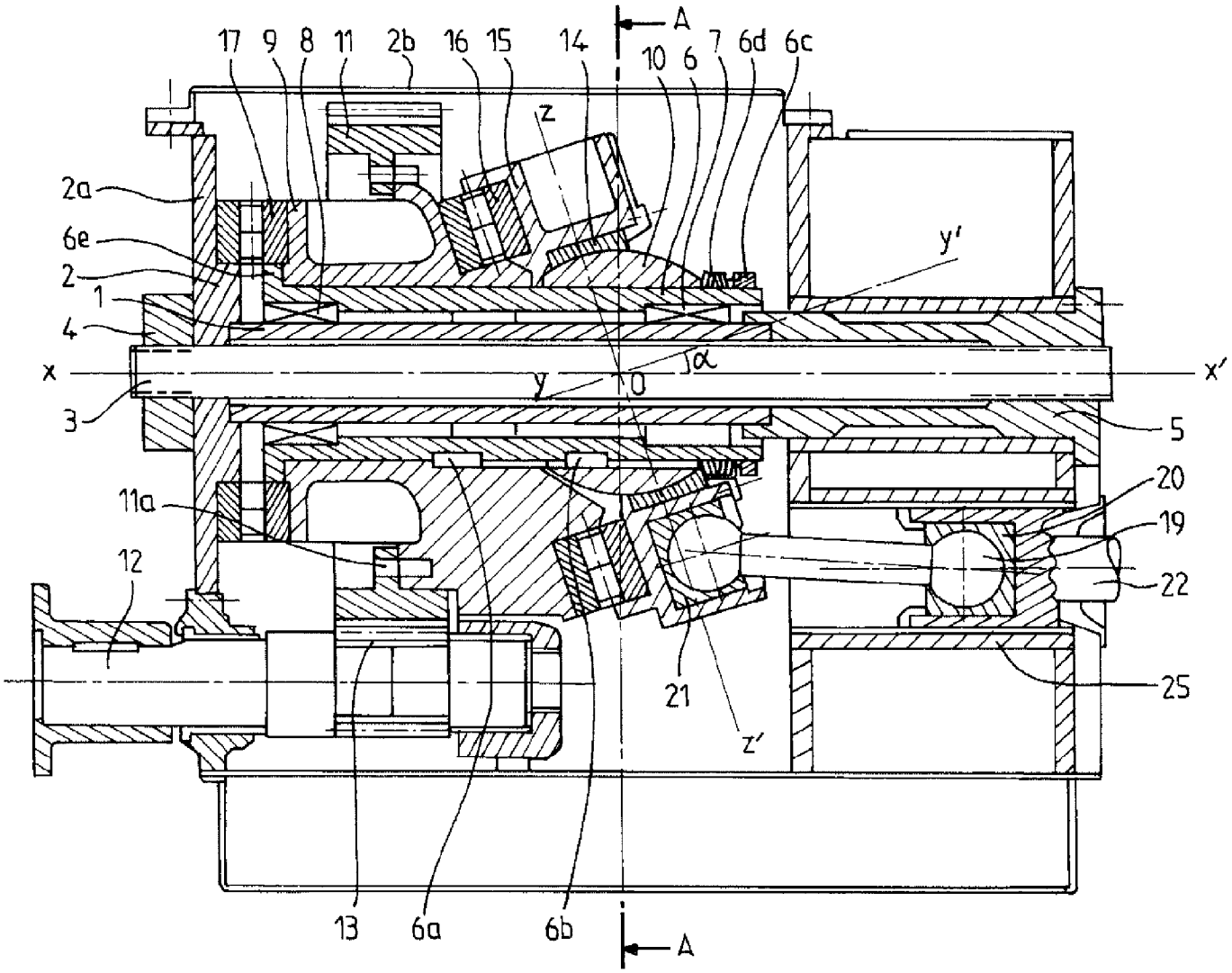

This application is a National Phase filing under 35 U.S.C. §371 of PCT/IB2009/053685 filed on Aug. 21, 2009; and this application claims priority to Application No. 0804916 filed in France on Sep. 8, 2008 under 35 U.S.C. §119; the entire contents of all are hereby incorporated by reference.

The present invention relates to a rotary machine with pistons and a barrel of the kind which comprise:

- a housing through which there passes a shaft mounted fixedly with respect to the housing,
- a thrust plate rotatably mounted on the shaft of geometric axis x-x',
- a wobble plate pressing against and guided in rotation about a geometric axis y-y' with respect to the thrust plate,
- a reaction rod a first end of which is connected to the housing and a second end of which is connected to the wobble plate,
- a female spherical bearing bushing secured to the wobble plate, articulated about a male spherical ball guided with respect to the shaft.

A machine of this type is described in patent FR 2 588 617, in the name of the same Applicant, to produce an axial piston pump. An external motor drives the rotation of the input shaft of the device which converts this rotational movement into a reciprocating translational movement imparted to pistons arranged parallel to the axis of rotation of the input shaft.

This machine uses a wobble plate guided by a spherical bearing bushing the reliability of which needs to be improved. Indeed, it has been found that it is difficult to lubricate the spherical bearing bushing entirely satisfactorily, and this has a negative impact on the life of the machine.

The object of the invention is, first and foremost, to propose a rotary machine of improved life and that can be used in an axial piston pump for numerous types of fluid and with high reliability.

According to the invention, a rotary machine with pistons and a barrel of the kind in question is characterized in that the ball comprises a male spherical bearing bushing rotatably mounted with respect to the shaft, and in that the rotary machine comprises a means of driving the rotation of the male spherical bearing bushing about the geometric axis x-x'.

The present invention therefore relates to a rotary machine with pistons and a barrel, with a wobble plate mounted on a central female spherical bearing bushing, which machine is notable in that the female bearing bushing wobbles about a male spherical bearing bushing which is itself driven in rotation, with the essential objective of making lubricating a bearing with a spherical bearing bushing just as easy and reliable as lubricating a bearing with a cylindrical bearing bushing.

The means of driving the rotation of the male spherical bearing bushing may comprise a rotation coupling means for rotatably coupling the male spherical bearing bushing to the thrust plate.

Advantageously, the thrust plate and the male spherical bearing bushing are mounted on one and the same sleeve rotatably mounted on the shaft and constituting the rotation coupling means.

The sleeve is driven in rotation by the thrust plate and the male spherical bearing bushing may be driven in rotation by the sleeve, via keys.

The sleeve may be guided in rotation with respect to the shaft by needle bearings.

A thrust roller bearing, the axes of which rollers are parallel to the surface via which the wobble plate presses against the thrust plate, may be positioned between the thrust plate and the wobble plate.

The thrust plate may be secured to a gearwheel driven by a pinion secured to an input shaft.

Advantageously, the axis x-x', a second axis y-y' of rotation of the wobble plate with respect to the thrust plate and an orthogonal third axis z-z' defining the possibilities of rotation of the female spherical bearing bushing with respect to the male spherical bearing bushing, converge at the center (O) of the male spherical bearing bushing (10), thus allowing the wobbling/rotating mechanism of the machine to be perfectly statically balanced.

Other features and advantages of the invention will become apparent from the following description of one preferred embodiment that makes reference to the accompanying drawings but is not in any way limiting.

Figure 2:
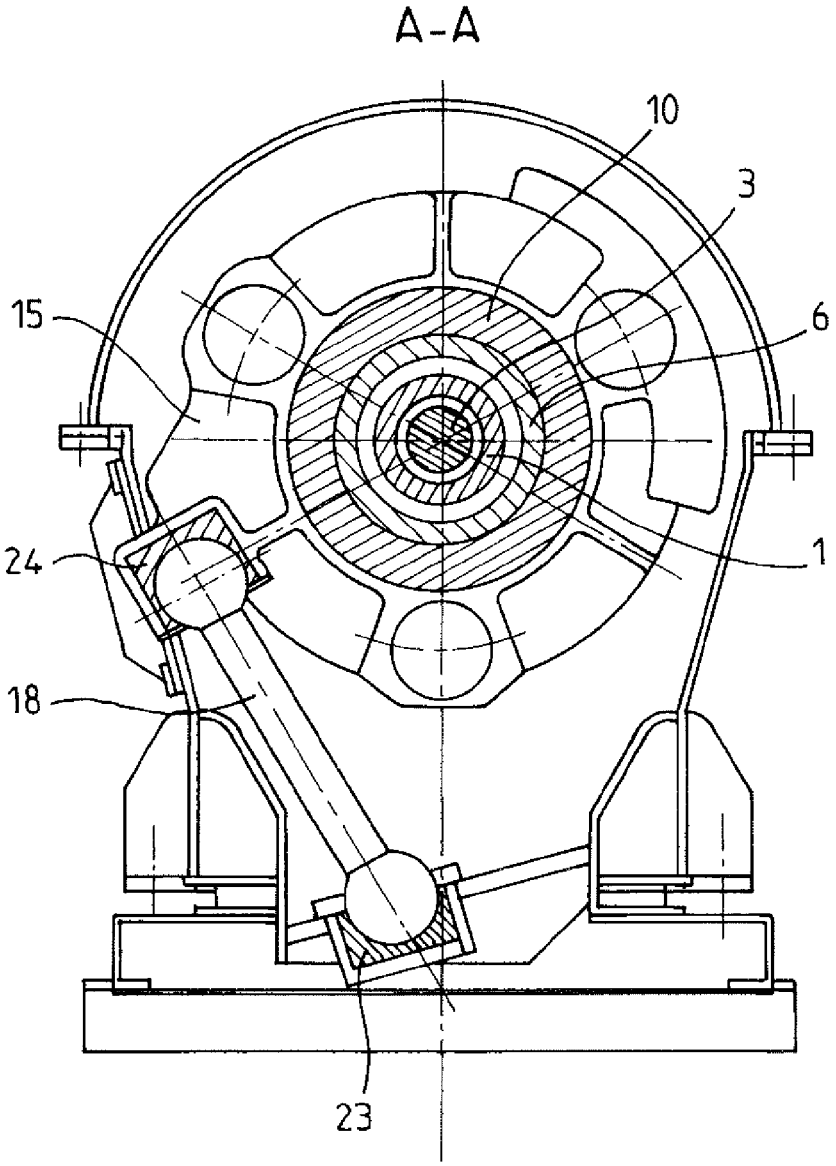

In these drawings:

FIG. 1 is an axial vertical section through a rotary machine according to the invention, and FIG. 2 is a section on A-A of FIG. 1 through the rotary machine of FIG. 1.

The present invention, illustrated by FIG. 1 and FIG. 2, shows a wobble plate pump 15 comprising a housing 2 through which there passes a shaft 1, of geometric axis x-x', mounted fixedly with respect to the housing 2. The housing 2 comprises a cover 2*b* situated between a flange 2*a* and a barrel 25. The hollow shaft 1 is held in a fixed position in the casing 2 by a threaded rod 3 and its two nuts 4 and 5.

A thrust plate 9 is rotatably mounted on the shaft 1. That face of the plate 9 that faces toward the barrel 25 is inclined, at an angle smaller than 90°, to the axis x-x'. Needle bearings 7 and 8 provide radial guidance of a sleeve 6. The sleeve 6 is driven in rotation by the plate 9 via a fixed key 6*a*. A thrust roller bearing 17 with cylindrical rollers, which is interposed between the plate 9 and the flange 2*a* of the housing 2, absorbs axial load.

A gearwheel 11 is fixed at the periphery of the plate 9 using pins 11*a*. An input shaft 12, mounted so that it can turn with respect to the housing 2 parallel to the axle 1, comprises a pinion 13 which meshes with the wheel 11.

A wobble plate 15 is secured to a female spherical bearing bushing 14 articulated about a male spherical bearing bushing 10 of center O situated on the axis x-x'.

According to the invention, the male spherical bearing bushing 10 is driven in rotation about the axis x-x' by the sleeve 6 via a sliding key 6*b*. The use of the key 6*b* makes it possible to avoid transmitting axial load. The sleeve 6 passes through the bearing bushing 10.

A thrust roller bearing 16 with cylindrical rollers, the geometric axis of rotation y-y' of which makes a non-zero angle $\alpha$ with respect to the first axis x-x', is interposed between the wobble plate 15 and the thrust plate 9. An axial thrust bearing 6*c* is secured to the end of the sleeve 6 and elastic washers 6*d* are interposed between the thrust bearing 6*c* and the male spherical bearing bushing 10.

From the thrust bearing 6*c*, axial load is transmitted to the male spherical bearing bushing 10, to the female spherical bearing bushing 14, to the wobble plate 15 and then to the thrust plate 9 via the thrust roller bearing 16. The thrust plate 9 is itself in abutment against a shoulder 6*e* provided at the end of the sleeve 6.

The shoulder 6*e* likewise allows the sleeve 6 and the thrust plate 9 to be secured to one another using fixing screws which have not been depicted. In addition, the thrust plate 9 is mounted on the sleeve 6 via a tight assembly supplementing the key 6*a*.

Thus it is possible, using the thrust bearing 6*c*, to adjust the preload in the elements between the thrust bearing 6*c* and the shoulder 6*e*.

A reaction rod 18 (FIG. 2) is fitted to prevent the wobble plate 15 from being rotationally driven about the axis x-x' while at the same time allowing it to wobble. A first end of the reaction rod 18 is articulated to the housing 2 and a second end is articulated to the wobble plate 15.

The reaction rod 18 is articulated in a bottom spherical bearing bushing 23 fixed in the housing of the pump and in a top spherical bearing bushing 24 fixed to the wobble plate 15.

When the input shaft 12 turns, the reaction rod 18 opposes any rotation of the wobble plate 15 which is thus guided in a wobbling movement by the thrust plate 9.

For each piston (not depicted), a link rod 19 is connected to the wobble plate 15 by a spherical bearing bushing 21. The link rod 19 is connected by a bearing bushing 20 to a crosshead 22, to which the piston (not depicted) of the pump is attached. The piston is thus given a rectilinear reciprocating movement with respect to the barrel 25, allowing pumping.

The device works as follows. The input shaft 12 drives the rotation of the pinion 13. The pinion 13 meshes with the wheel 11 which drives the rotation of the thrust plate 9 via the pins 11*a*. The thrust plate 9 drives the rotation of the sleeve 6, via the key 6*a*.

The sleeve 6 drives the rotation of the male spherical bearing bushing 10.

The wobble plate 15 presses against the inclined surface of the thrust plate 9 via the roller thrust bearing 16 with cylindrical rollers. The female spherical bearing bushing 14, secured to the plate 15, slides over the male spherical bearing bushing 10, which is driven in rotation.

The female spherical bearing bushing 14 is given a wobbling movement while the male spherical bearing bushing 10 is given a rotational movement rotating about the axis xx'. Thus, lubricating the male/female spherical bearing bushings 10 and 14 here is just as easy and just as reliable as lubricating a cylindrical bearing bushing because a point on the female sphere with respect to a point on the male sphere describes a locus in the form of a "creeping sinusoidal path" at a high and continuous linear speed, which is good for maintaining the oil film. Lubrication is thereby enhanced and this has a positive impact on the life of the machine.

The axis z-z' is orthogonal to the axis y'-y' and therewith defines the possibilities of rotation of the female spherical bearing bushing 14 with respect to the male spherical bearing bushing 10.

It will be noted that the axes xx', yy' and zz' are exactly convergent here, converging at the center O, thus ensuring perfect wobbling about the point O and allowing the wobbling/rotating mechanism of the machine to be perfectly statically balanced.

Because the liquid pumped is completely isolated from the space in which the bearing bushings 10 and 14 are located, the pumped liquid can be laden with solid particles without this inconveniencing the bearing bushings. This layout is particularly advantageous for pumps used in boreholes, particularly in the petroleum industry.

The invention claimed is:

1. A rotary machine with pistons and a barrel, comprising: a housing through which there passes a shaft, of geometric axis x-x', mounted fixedly with respect to the housing, a thrust plate rotatably mounted on the shaft, a wobble plate pressing against the thrust plate, a reaction rod a first end of which is articulated to the housing and a second end of which is articulated to the wobble plate, a female spherical bearing bushing secured to the wobble plate, articulated about a male spherical bearing bushing centered on the shaft, wherein the male spherical bearing bushing is rotatably mounted with respect to the shaft, and the rotary machine comprises a means of driving the rotation of the male spherical bearing bushing about the geometric axis x-x', and wherein:

the means of driving the rotation of the male spherical bearing bushing comprises a rotation coupling means for rotatably coupling the male spherical bearing bushing to the thrust plate, and the thrust plate and the male spherical bearing bushing are mounted on one and the same sleeve rotatably mounted on the shaft and constituting the rotation coupling means, the sleeve including a key for driving rotation of the male spherical bearing bushing, wherein the key does not transmit axial load between the thrust plate and the male spherical bearing bushing, with axial load through the male spherical bearing bushing to the thrust plate being transmitted through the wobble plate.

2. The rotary machine as claimed in claim 1, wherein the sleeve is driven in rotation by the thrust plate and the male spherical bearing bushing is driven in rotation by the sleeve via respective keys.

3. The rotary machine as claimed in claim 1 wherein the sleeve is guided in rotation with respect to the shaft by needle bearings.

4. The rotary machine as claimed in claim 1, wherein a thrust roller bearing, the axes of which rollers are parallel to the surface via which the wobble plate presses against the thrust plate, is positioned between the thrust plate and the wobble plate.

5. The rotary machine as claimed in claim 1, wherein the thrust plate is secured to a gearwheel driven by a pinion secured to an input shaft.

6. The rotary machine as claimed in claim 1, wherein the axis x-x', a second axis y-y' of rotation of the wobble plate with respect to the thrust plate and an orthogonal third axis z-z' defining the possibilities of rotation of the female spherical bearing bushing with respect to the male spherical bearing bushing, converge at the center of the male spherical bearing bushing, thus allowing the wobbling/rotating mechanism of the machine to be perfectly statically balanced.

7. The rotary machine as claimed in claim 1, wherein a thrust bearing is interposed between the wobble plate and the thrust plate, wherein an axial thrust bearing is secured to the end of the sleeve, and wherein elastic washers are interposed between the axial thrust bearing and the male spherical bearing bushing, the axial thrust bearing transmitting axial load through the male spherical bearing bushing to the thrust plate while compressing the elastic washers.

8. The rotary machine as claimed, in claim 1, wherein a link rod is connected by a first spherical bearing to the wobble plate and by a second spherical bearing to a crosshead, to which a piston of a pump is attached.

* * * * *